United States Patent [19]

Blake

[11] Patent Number: 4,896,373

[45] Date of Patent: Jan. 23, 1990

[54] DESK WITH DASHBOARD FACING

[76] Inventor: Paul M. Blake, 7 Colonial La., Canton, Mass. 02021

[21] Appl. No.: 101,867

[22] Filed: Sep. 25, 1987

[51] Int. Cl.[4] ..... H04B 1/06

[52] U.S. Cl. ..... 455/344; 446/7

[58] Field of Search ..... 455/344–347; 379/436; D6/396, 407, 413, 422; 362/23; 446/7

[56] References Cited

U.S. PATENT DOCUMENTS

| | | | |
|---|---|---|---|
| 1,793,792 | 2/1931 | Gommesen | 455/344 |
| 2,291,796 | 8/1942 | Crowley | 455/344 |
| 2,571,903 | 10/1951 | Loewi et al. | 455/344 |
| 3,120,716 | 2/1964 | Orensten | 446/7 |
| 3,231,988 | 2/1966 | Freyde | 446/7 |
| 4,208,831 | 6/1980 | Strauss | 446/7 |
| 4,265,047 | 5/1981 | Meyer et al. | 446/7 |
| 4,462,564 | 7/1984 | Alves | 455/345 |
| 4,694,486 | 9/1987 | Yuter | 379/436 |

*Primary Examiner*—Robert L. Griffin

*Assistant Examiner*—Curtis Kuntz

*Attorney, Agent, or Firm*—H. Jay Spiegel

[57] ABSTRACT

Disclosed herein is a desk including a plurality of legs designed to support the desk on a floor surface, a planar surface substantially perpendicular to the legs and designed as a support surface for supporting various articles and to be used as a writing surface. Finally, the desk includes at its rearmost portion an upstanding structure which is made to resemble the dashboard of a vehicle including the visualization of an instrument panel, ventilation ducts and the like. The dashboard facing further includes a working high-fidelity stereo system which may include an AM-FM stereo receiver, tape deck, graphic equalizer and other stereo equipment as desired. Furthermore, at each end of the facing, speakers are mounted which are functional. If desired, the facing may include the visualization of a steering wheel, and the instrument visualization as well as the indicators for the stereo equipment may include selectively operable backlighting.

11 Claims, 2 Drawing Sheets

DESK WITH DASHBOARD FACING

BACKGROUND OF THE INVENTION

In the prior art it is well known to provide a desk with a radio incorporated therewithin for convenience purposes. U.S. Pat. No. 1,793,792 to Gommesen discloses a table having a radio built in which table includes a pivoting door on the side of the table to gain access to the radio controls and a table top which may be selectively pivoted upwardly, with the radio including a speaker either facing downwardly as shown in FIG. 4 or upwardly from the bottom leg support as seen in FIG. 6.

Furthermore, U.S. Pat. No. 2,291,796 to Crowley discloses the concept of a table of the single pedestal support type which has contained in the base thereof several of the radio components with others of the components being mounted within the table top itself.

Neither of these patents teaches the concept of a desk including a table top and an upstanding portion including high fidelity stereo-radio components. Furthermore, neither of these patents teaches the concept of incorporation of high- fidelity stereo-radio components in a structure made to resemble the dashboard of a vehicle. A need has developed for such a device and the present invention has been specifically devised to answer this need.

SUMMARY OF THE INVENTION

The present invention relates to an improved desk with dashboard facing. The present invention includes the following interrelated aspects and features:

(A) In a first aspect of the present invention, the inventive desk includes a plurality of legs, preferably four legs, one at each corner of the desk to support the desk in an upright position. Of course, if desired, a pedestal-type support may instead be provided.

(B) Mounted on the support structure whether one or a plurality of legs is a table top of flat configuration which may be made of any desired shape such as rectangular, square, circular and the like.

(C) The table top is provided to support items placed thereon and also is flat so that it may be used as a writing surface.

(D) At the rearmost location of the table top from the perspective of the user sitting in a chair before the desk, an upstanding structure is provided which is made to resemble the dashboard of a vehicle such as an automobile.

(E) This structure consists of a "dashboard facing" which includes the visualization of instruments such as speedometer, tachometer, pressure, temperature and electrical indicators, the visualization of ventilation vents, and an actually operating high fidelity stereo system including speakers mounted at each end of the facing, and stereo equipment mounted in the same manner as one might expect such equipment to be mounted in the dashboard of a vehicle and including as desired an AM-FM stereo receiver, a tape deck for playing cassette tapes, a graphic equalizer for adjusting the frequency response of the device, and, if desired, a compact disc player. The stereo equipment may be powered through the use of batteries or, if desired through electrical power from a wall socket.

(F) If desired, the visualization of vehicle venting may be actually operable vents, for example, of the louvre-type and the device may, if desired, include a ventilation system incorporated in the facing powered by a battery power or alternating current type power source including a fan with a motor design to rotate the fan and thereby cause circulation of air through the vents. If desired, the system may include provisions for cooling and/or heating structure mounted within the dashboard facing as desired so that air which is blown through the vents may be conditioned by heating or cooling prior to being blown through the vents.

(G) Finally, the dashboard facing may be provided with the visualization of a glove compartment which may in fact include an operable door which may be pivoted or otherwise opened to reveal a storage compartment for items which may be used on the desk. If desired, the visualization of the instruments may include a steering wheel visualization and all instruments and stereo components may have back lighting, the intensity of which may be selectively adjusted.

Accordingly, it is a first aspect of the present invention to provide an improved desk with a dashboard facing included therewith.

It is a further object of the present invention to provide such a device wherein some of the components thereof are mere visualizations of vehicle dashboard components and others of the components are actually working devices.

It is a still further object of the invention to provide such a device wherein the dashboard facing has mounted therein working stereo high-fidelity equipment.

It is a still further object of the present invention to provide such a device including working ventilation equipment incorporated therewith as well as storage facility through a glove compartment-storage compartment.

These and other objects, aspects and features of the present invention will be better understood from the following detailed description of the preferred embodiments thereof when read in conjunction with the appended drawing figure.

SPECIFIC DESCRIPTION OF THE PREFERRED EMBODIMENTS

Figure 1:
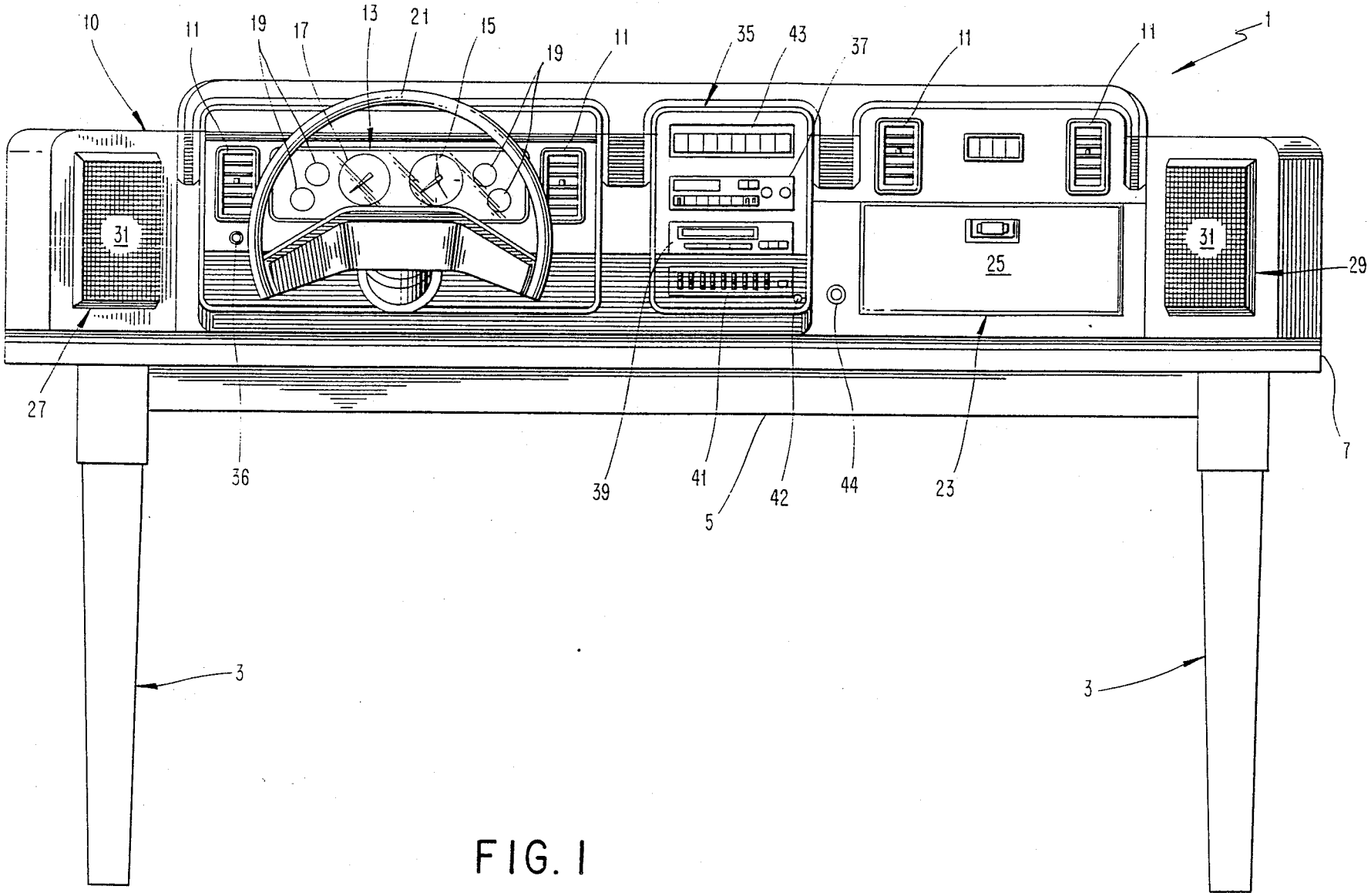
FIG. 1 depicts a front view of the present invention.

With reference to the Figures, the present invention is generally designated by the reference numeral 1 and is seen to include a plurality of legs 3, a structural support member 5 and a table top 7 which may be of any desired shape or configuration although in the preferred embodiment the shape would be rectangular.

At the rearmost portion (FIGS. 2 and 3) of the top table 7, a facing 10 is provided which as best seen in FIG. 1 is made to resemble the dashboard of a vehicle. The facing 10 includes plural vents 11, and an instrument panel 13 including, preferably, visualization of a speedometer 15, a working clock 17, and other gauges 19 which may, if desired, be visualizations of temperature, pressure, and electrical function gauges.

Figure 2:
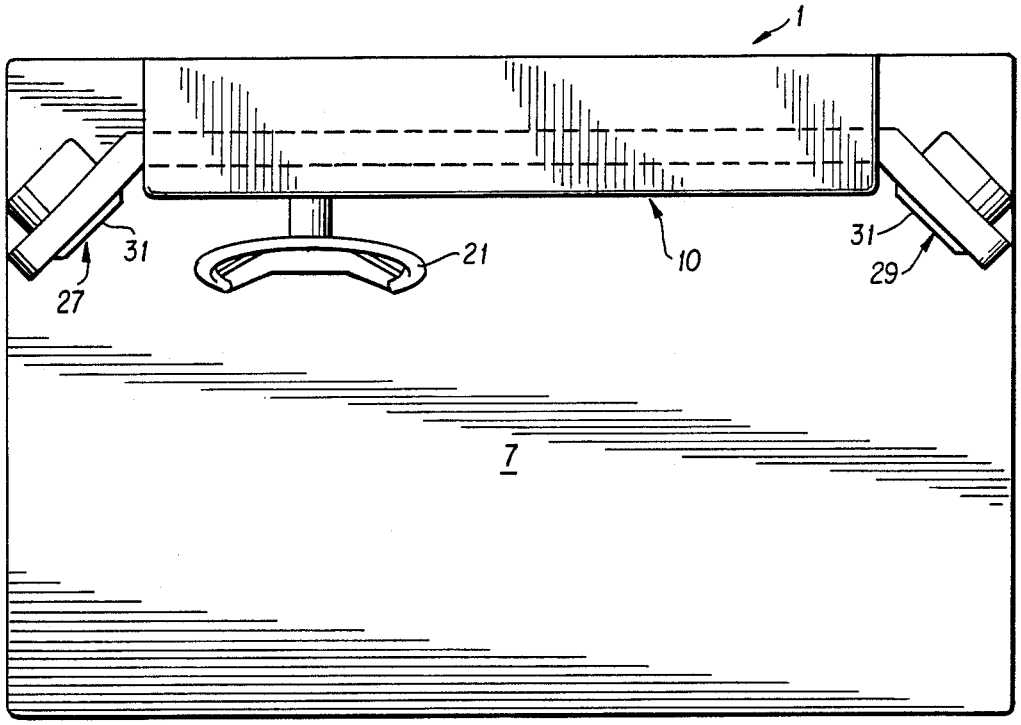
FIG. 2 depicts a top view of the present invention.
Figure 3:
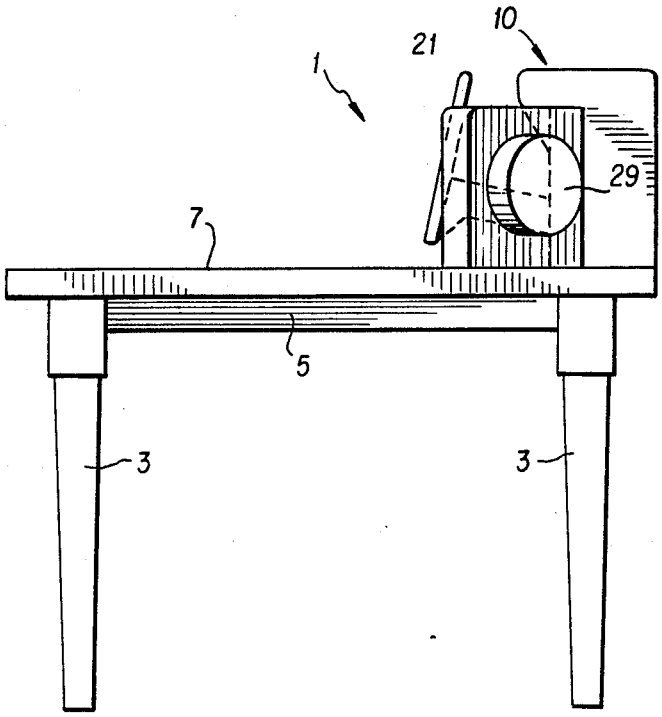
FIG. 3 depicts a side view of the present invention.

As best seen in FIG. 2, the facing 10 may have protruding therefrom a short distance a steering wheel 21, and, further, a glove compartment 23 (FIG. 1) may be provided including a door 25 for allowing access to an interior storage compartment which may be used to store writing and other materials.

As further seen in the figures, the facing 10 includes at its lateral ends a pair of speakers 27, 29, each of which has a protective grill 31. Substantially centrally mounted on the facing 10 is a high-fidelity stereo component package 35 which, as shown, includes an AM-FM stereo receiver 37, a tape deck 39, a graphic equalizer 41, an earphone jack 42 and a further component 43 which may, if desired, be a compact disc player. If desired, the components of the package 35 may be of the pull-out type for security reasons and also since the components could be shared between the desk 1 and a vehicle owned by the user. The package 35 is powered by a power source (not shown) which may, if desired, comprise batteries or a cord connection to an electrical power source such as a wall outlet of a home or office.

Of course, the package 35 is interconnected with the speakers 27, 29 through the appropriate electrical wiring and of course the package 35 will include, most likely embodied in the receiver 37, amplifier structure as well as volume, tone and balance controls to control the output of the speakers 27, 29.

In a further aspect, the vent devices 11 may either be visualizations of vehicle vent structure, or alternatively, may in fact be actually operating vent devices which include structure allowing control of the amount of opening of the louvres thereof as well as the direction of flow of air flowing therethrough. If desired, the facing 10 may have incorporated therein ventilation structure allowing air to be blown through the vents 11 for the comfort of the user of the desk 1. In this regard, if desired, a compact air-conditioning and/or heating system may be provided mounted within the facing 10 to circulate air from the room where the desk 1 is located through the vents 11 after conditioning the air by heating and/or cooling thereof. Of course, each ventilation equipment (not shown) may be powered either by batteries or through the use of a plug into an electrical socket of a home or office. Additioally, a cigarette lighter 44 may be provided.

Of course, various modifications of the teachings of the present invention may be contemplated by those skilled in the art. Modifications may include but are not limited to the number of support legs 3, he shape of the table top 7, the particular orientation of the components within the facing 10 and the like. For example, the legs 3 may if desired be replaced with a single pedestal-type support. Furthermore, the table top 7 may be of a square, rectangular or circular shape and, if desired, the facing 10 may be designed to curve to conform with the edge of the table top 7 in the case of a curved-type periphery thereof. In a further aspect, if desired, the instrument panel 13 and package 35 may include back lighting which may be adjustable by knob 36 as to intensity in the same manner as such structure is adjustable in a normal vehicle. Such adjustablility may be carried out in a manner well known to those skilled in the art.

As such, an invention has been described in terms of a preferred embodiment thereof which fulfills each and every one of the objects of the invention as set forth hereinabove and provides an improved desk having ar esthetically pleasing structure in the form of a vehicle simulating dashboard facing. Of course, again, various changes, modifications and alterations in the teachings of the present invention may be contemplated by those skilled in the art without departing from the intended spirit and scope thereof. Accordingly, it is intended that the present invention only be limited by the appended claims.

What is claimed is:

1. An improved desk comprising:

(a) a substantially planar surface provided with a writing surface thereon;

(b) support means for supporting said planar surface at a predetermined distance above an adjacent floor surface; and (c) said planar surface having a front portion and a rear portion having a rear edge with the rear edge having extending in adjacency upwardly therefrom a vertical facing made to resemble the dashboard o a vehicle facing toward said front portion and in cluding the visualization of a vehicle instrumen panel, said writing surface extending from said front portion to said facing and comprising a ma jority of said planar surface.

2. The invention of claim 1, wherein said suppor means comprises a plurality of spaced legs.

3. The invention of claim 1, wherein said planar sur face is substantially rectangular in configuration.

4. The invention of claim 1, wherein said facing in cludes at least two speakers mounted therein at spaced locations thereon, and a stereo system adapted to broad cast program material through said speakers.

5. The invention of claim 4, wherein said stereo sys tem comprises:

(a) a radio receiver;

(b) a cassette tape deck; and (c) a graphic equalizer.

6. The invention of claim 5, wherein said radio re ceiver is an AM-FM receiver, and further wherein said stereo system includes a compact disc player.

7. The invention of claim 1, wherein said facing in cludes a storage compartment made to resemble a vehicle glove compartment including a door which whe opened reveals a storage compartment of said glov compartment.

8. The invention of claim 1, wherein said facing in cludes a simulation of a vehicle steering wheel.

9. The invention of claim 8, further including adjus able lighting means for adjustably lighting said instru ment panel visualization.

10. The invention of claim 1, wherein said facin includes operable vent means and said facing ha mounted therein a ventilation system adapted to circu late air through said vent means for providing ventila tion to a user of said desk.

11. The invention of claim 10, wherein said ventila tion means comprises the combination of heating an cooling means for conditioning air which is thereafte circulated through said vent means.

* * * * *